US006558128B2

(12) United States Patent
Marvel et al.

(10) Patent No.: US 6,558,128 B2
(45) Date of Patent: May 6, 2003

(54) FLUID WELL PUMPING SYSTEM

(76) Inventors: John E. Marvel, 711 E. 800 South, Fairmont, IN (US) 46928-9216; Michael A. Porch, 603 W. 38th St., Anderson, IN (US) 46013

( * ) Notice: Subject to any disclaimer, the term of this patent is extended or adjusted under 35 U.S.C. 154(b) by 0 days.

(21) Appl. No.: 10/191,915

(22) Filed: Jul. 9, 2002

(65) Prior Publication Data

US 2002/0182089 A1 Dec. 5, 2002

Related U.S. Application Data

(60) Continuation of application No. 09/640,926, filed on Aug. 17, 2000, now Pat. No. 6,435,838, which is a division of application No. 09/095,963, filed on Jun. 11, 1998, now abandoned.

(51) Int. Cl.[7] ..... F04B 9/12

(52) U.S. Cl. ..... 417/46; 417/121; 417/254; 417/392; 417/904

(58) Field of Search ..... 417/46, 244, 254, 417/392, 904, 121, 122

(56) References Cited

U.S. PATENT DOCUMENTS

| | | | | |
|---|---|---|---|---|
| 657,917 | A | * 9/1900 | Conrader | 417/121 |
| 1,604,421 | A | * 10/1926 | Oliphant | 417/121 |
| 1,929,674 | A | 10/1933 | Canfield | |
| 2,142,773 | A | 1/1939 | Athey | |
| 2,173,413 | A | 9/1939 | Foster | |
| 2,340,943 | A | 2/1944 | Downs | |
| 2,429,848 | A | 10/1947 | Smith | |
| 2,442,642 | A | 6/1948 | Eckel | |

(List continued on next page.)

OTHER PUBLICATIONS

"Introduction to Gas Lift," EVI Oil Tools, © 9/97.
"Guard Dog II Oil Lift Systems," Scientific Oilfield Systems, Inc.
"More Oil–Less Toil • • Much Gas–At Last," Oiltizer, vol. 20, No. 8, Jan. 25, 1997, p. 2.
"Fee and Low Cost New SOS Oil Production Technology", Scientific Oilfield Systems, Inc.
"More Oil—Less Toil • • Much Gas—At Last," Scientific Oilfield Systems, Inc.

*Primary Examiner*—Ehud Gartenberg
(74) *Attorney, Agent, or Firm*—Woodard, Emhardt, Naughton, Moriarty & McNett LLP

(57) ABSTRACT

A fluid pumping system includes a number of stages. Each stage has a fluid chamber having a top end with an air aperture and a bottom end with a fluid apertures. An air line is connected to the air aperture, and a fluid input conduit, with an input check valve, is connected to the fluid aperture. A float valve is disposed in the chamber directly between the fluid aperture and the air aperture. A fluid output conduit is connected to the fluid aperture above the input check valve. The float has a bottom end adapted to seal with the fluid aperture when the chamber is empty. A first set of pumping stages are supplied by a first compressed air line and a second set of pumping stages are supplied by a second compressed air line. Periodically, compressed air is supplied to a first set of pump stages to drive fluid from each of the first set of pump stages to a second set of stages, and vice versa. This cycle is repeated with the fluid alternating between the first and second sets of pumping stages until the fluid is recovered at a collection point. The compressed air can be cycled from one set of stages to the other based on time, a sensed activity in the well, a sensed volume of fluid being stored, a sensed air flow and/or any combination of the above. Additionally, a dual chamber mode of the invention is described.

15 Claims, 11 Drawing Sheets

U.S. PATENT DOCUMENTS 2,807,216 A 9/1957 Bielstein
2,822,757 A 2/1958 Coberly
2,843,046 A 7/1958 Knowles
2,862,448 A 12/1958 Belding
3,306,216 A 2/1967 Warman
3,601,191 A 8/1971 McMurry et al.
3,736,983 A 6/1973 Beard et al.
3,894,814 A * 7/1975 Morgan ..... 417/121
3,991,825 A * 11/1976 Morgan ..... 166/68
4,050,854 A 9/1977 Hereford et al.
4,076,457 A * 2/1978 Skinner et al. ..... 417/45
4,439,110 A 3/1984 Massaux
4,460,048 A 7/1984 Smith et al.
4,537,256 A 8/1985 Beard
4,589,494 A 5/1986 Sakoda
4,653,989 A 3/1987 Mason
5,141,404 A 8/1992 Newcomer et al.
5,161,956 A 11/1992 Fiedler
5,183,391 A 2/1993 Fiedler

* cited by examiner

FLUID WELL PUMPING SYSTEM

CROSS-REFERENCE TO RELATED APPLICATIONS

The present application is a continuation application of U.S. patent application Ser. No. 09/640,926, filed Aug. 17, 2000, now U.S. Pat. No. 6,435,838, which is a divisional application of U.S. patent application Ser. No. 09/095,963, filed Jun. 11, 1998, now abandoned, each of which is incorporated herein by reference in its entirety.

BACKGROUND

Conventional systems are known for removing fluid such as water or oil from wells where there is an abundant supply of fluid, however, in shallow locations or locations with a low production volume, these systems may not be cost justified. For example, in oil formations 500–1000 feet deep which only produce a few barrels of oil per day, multiple oil wells are often situated close together. Equipment and maintenance costs are often economically prohibitive in these shallow wells.

Furthermore, due to pressure, chemical conditions, and sand and grit in most oil wells the equipment is subject to high breakdown rates and requires frequent maintenance, repair or replacement. Consequently, particularly for a shallow, low production situations, there is a need for inexpensive, low maintenance pumping systems. Prior approaches to this type of pumping system have involved complex controls, sensors and electronics normally lowered into the well. This results in excess complexity, cost and maintenance.

One approach to a pumping system is shown in U.S. Pat. No. 4,653,989 issued to Mason. Mason shows a series of pneumatic displacement chambers connected to an air compressor at the surface of the well, by a single air line. Each chamber is connected to the air line through a motorized valve. A float including a disk shaped magnet, rides up and down in each displacement chamber. When fluid fills the chamber, the float approaches the top and the magnet is detected by a sensor which causes the control system to open the motorized valve connecting the chamber to the air line. Once the motorized valve is open, compressed air forces the fluid into the next chamber, or alternatively, into a holding tank on the surface. As the float approaches the bottom of the chamber, the magnet is detected by a sensor which causes the control system to close the motorized valve connecting the chamber to the air line. The Mason patent additionally teaches that the float be provided with flutes between its lower surface and the internal surface of the chamber to avoid the possibility of the float being used as a valve. The design of the Mason patent is costly and complex, requiring a magnetic sensor system located down hole and a motorized valve in connection with each chamber of the well pump, in addition to other shortcomings.

Another well pump is shown in U.S. Pat. No. 4,050,854 to Hereford et al. The Hereford patent shows a well pump including chambers that are costly and complex, among other disadvantages.

Consequently, there remains a need for a simple, efficient, low cost, low maintenance pumping system with a minimum of electronic components and complexity. The present inventions address these needs.

SUMMARY

It is an object of this invention to provide an improved fluid pumping system.

It is a further object of this invention to provide a simple, efficient, low-cost, low-maintenance pumping system.

Further objects, features and advantages of the present inventions shall become apparent from the detailed drawings and descriptions provided herein.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Fluid pumping systems according to the present inventions provide improved, low cost, efficient and low maintenance pumping systems for obtaining fluid from a source. It is envisioned that the systems will be used for removing water or oil from shallow wells, but the invention has application for raising any fluids as needed above ground. In connection with the embodiments below, raising oil from shallow oil wells will be particularly discussed.

Figure 1:
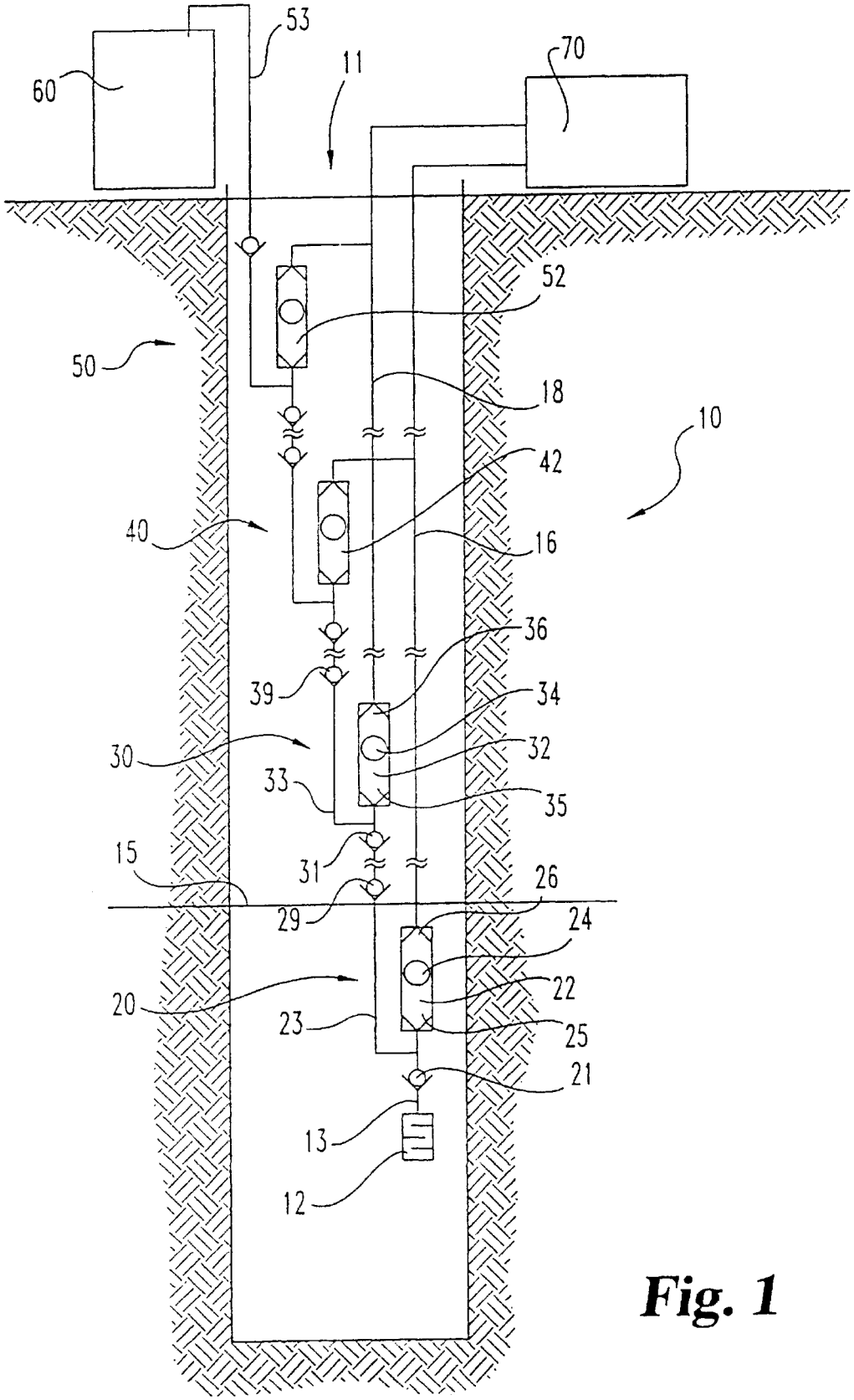
FIG. 1 is a schematic view of one embodiment of the present invention.
Figure 2:
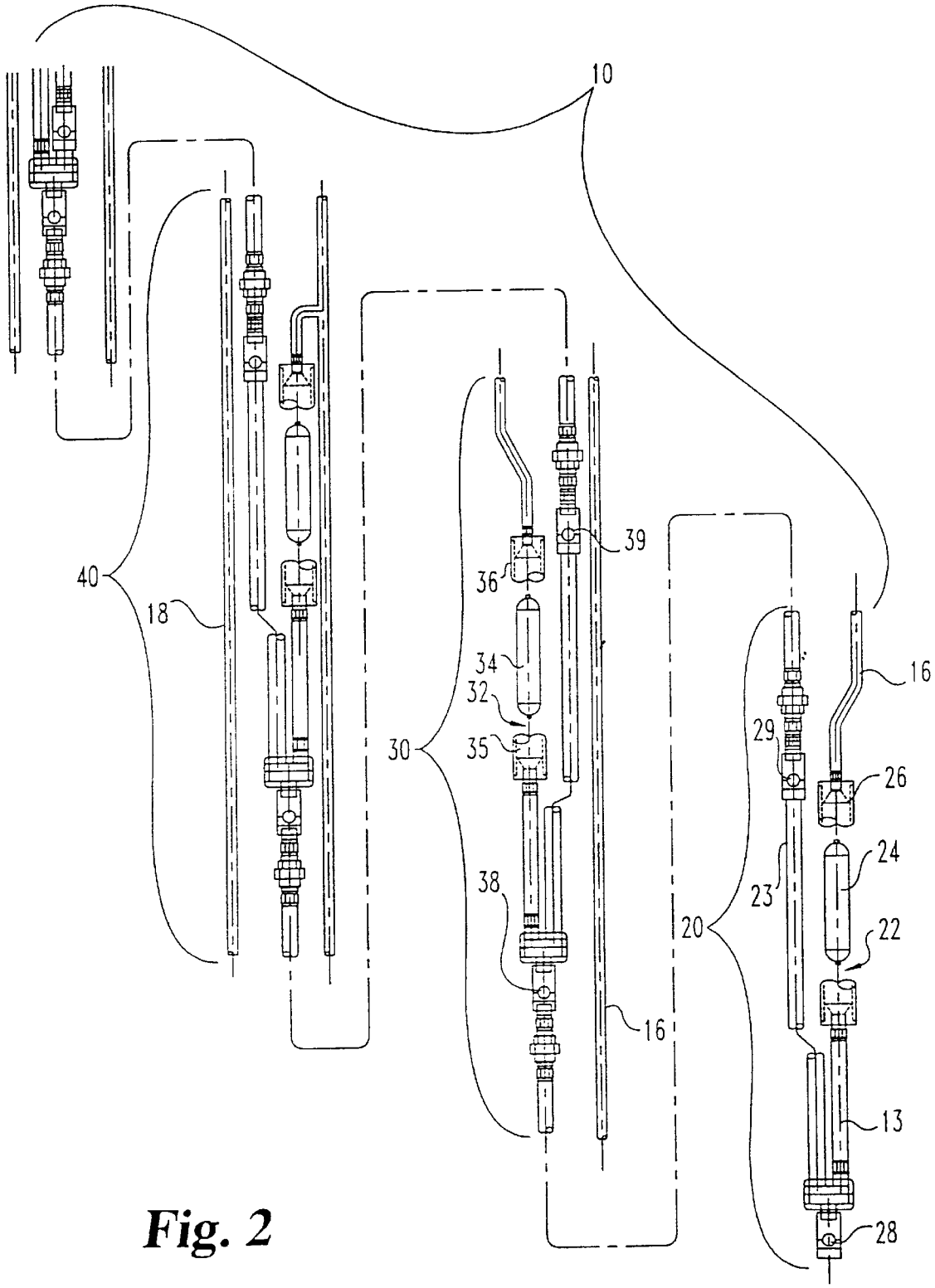
FIG. 2 is a partial cut-away view of multiple pumping stages according to one embodiment of the invention.

As illustrated in FIG. 1, a multi-stage pumping system 10 is located in well 11 having a fluid level 15. Although the present inventions will work with any number of stages, the embodiment of FIG. 1 is shown as having at least four stages. FIG. 2 is a partial cut-away view of multiple pumping stages of one implementation of FIG. 1.

First pumping stage 20 is located below fluid level 15. A filter, packing material or other type of strainer 12 is located at the lowest input point for the fluid and is attached to fluid input conduit 13. Fluid input conduit 13 includes check valve 21 and feeds into fluid chamber 22. Fluid chamber 22 has top end 26 with an air aperture and bottom end 25 with a fluid aperture. Float 24 is within fluid chamber 22. First compressed gas line 16 is coupled to an aperture at the top end 26 of chamber 22. Although, the present invention is described using compressed air, this is not meant to be limiting, as it is intended that the system could be used with compressed air or some other compressed gas, i.e. natural gas. Fluid output conduit 23 is connected to the fluid aperture above check valve 21 and forms the fluid input conduit for second stage 30. Output check valves 29 and 31 are located in fluid output conduit 23. One reason for using two check valves is to reduce the pressure in the output conduit 23 when filled with fluid. In some cases of low pressure shallow wells, it may be possible to omit one of check valves 29 and 31.

Second pumping stage 30 is substantially similar to first stage 20 of FIG. 1, and is located above first stage 20, closer to ground level. Usually there is about 200–300 feet between pumping stages, and 200–300 feet between the final pumping stage and the holding tank. Fluid output conduit 23 from first stage 20 serves as the fluid input conduit for pumping stage 30. Second stage fluid chamber 32 has top end 36 with an air aperture, bottom end 35 with a fluid aperture, and contains float 34. Second compressed air line 18 is coupled to the air aperture at top end 36 of fluid chamber 32. Fluid output conduit 33 includes output valve 39 and serves as the fluid input conduit for third pumping stage 40, if such a third stage is desired.

Pumping stage 40 is substantially similar to first pumping stage 20 and is connected to first compressed air line 16. As needed, a first set of essentially identical pumping stages (first, third, fifth, etc.) are connected to compressed air line 16. A second set of similar pumping stages (second, fourth, sixth, etc.) are connected to compressed air line 18. The final fluid output conduit 53, shown exiting an optional pumping stage 50, leads to storage tank 60 or a similar collection point. Control unit 70 including a compressor and control circuitry is used to supply compressed air to first compressed air line 16 and second air line 18. FIGS. 8–11 are block diagrams of some of the control units which may be used as control unit 70 of FIG. 1. Any of the control units of FIGS. 8–11 may be used as the control unit 70 of FIG. 1.

Figure 8:
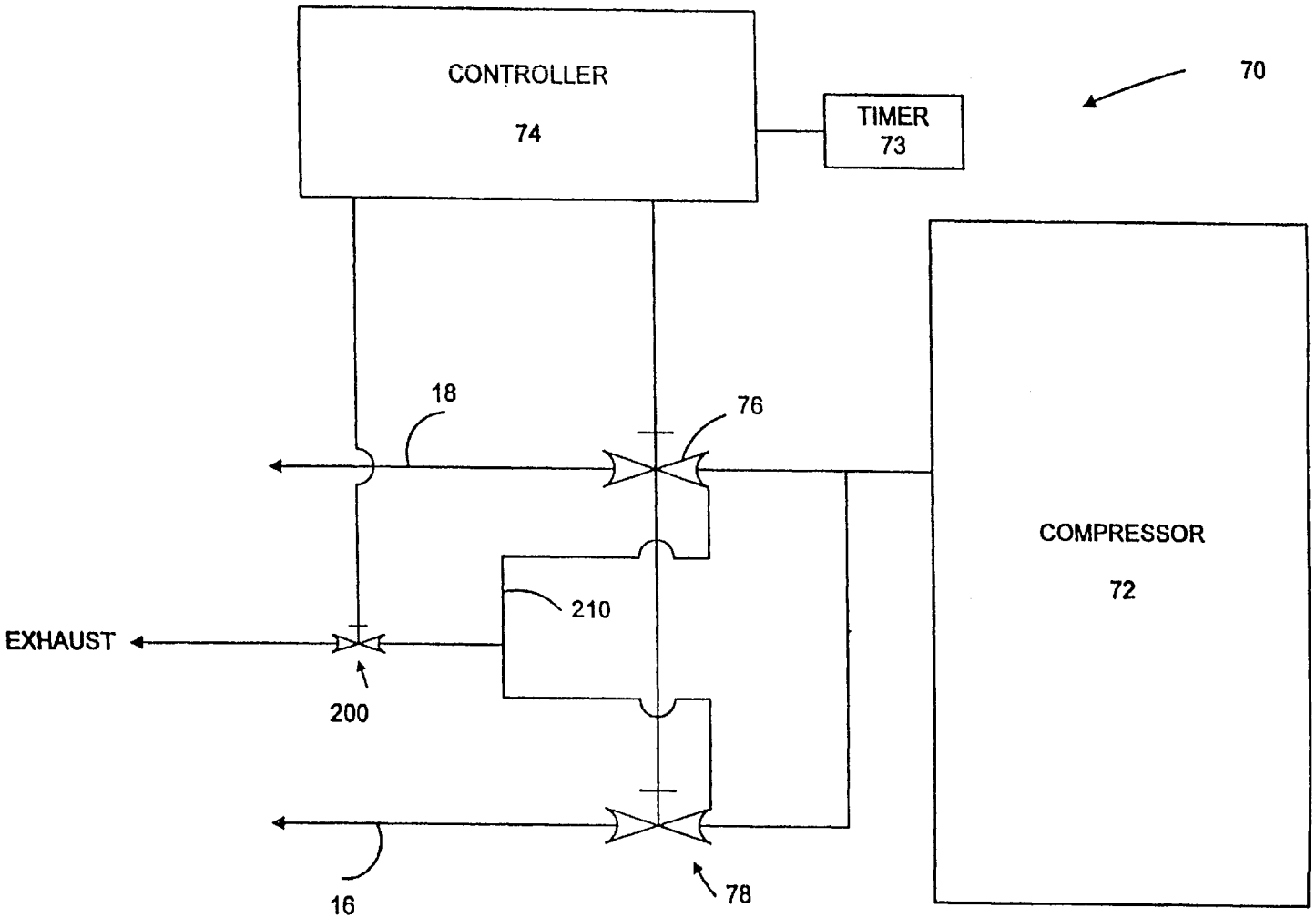
FIG. 8 is a block diagram of a control unit for use with one embodiment of the present invention.

More specifically, FIG. 8 shows in block diagram form the control unit 70 of one embodiment of the present inventions. A compressor 72 provides a compressed gas, such as air or natural gas to compressed gas line or air line 18 via a valve 76. Similarly, compressor 72 provides a compressed gas to compressed gas line or air line 16 via a valve 78. Valves 76 and 78 are three-way valves, such that when valves 76 and 78 are turned off (de-energized), air lines 18 and 16, respectively, are exhausted to atmosphere through an exhaust port of each valve. Conversely, when valves 76 and 78 are turned on (energized), the compressed gas from the compressor is provided to air lines 18 and 16, respectively. This configuration permits displaced air from a filling chamber to be vented to atmosphere.

However, the above described use of three-way valves is not meant to be limiting. Alternately, valves 76 and 78 may be conventional two-way valves, and additional two way valves (not shown) may be provided in fluid communication with each of air lines 16 and 18, connected in parallel with valves 78 and 76, respectively. As such, when not pressurized, lines 16 and 18 may be vented through the additional valves. The additional valves would likewise be controlled by controller 74. Additionally, instead of providing the additional venting valves in communication with air lines 16 and 18, additional venting lines can be provided to each chamber, which would then be in communication with the additional venting valves for the purpose of permitting air displaced from those chambers while filling to be vented to atmosphere.

A controller 74, receives an input from a timer 73 and, pursuant to the timer input, toggles the valve configuration to alternately cycle valves 76 and 78 open and closed. Controller 74 may include therein a microprocessor programmed to alternately cycle valves 76 and 78 open and closed, or it may include conventional logic circuitry for accomplishing the same function. In one embodiment of the present invention, controller 74 includes conventional relay logic to control the valves. It is additionally possible to use a programmable logic controller (PLC) as part of the controller 74 as an alternative to conventional relay logic. In the embodiment of FIG. 8, the timer 73 (which may be a separate timer, or may be integrated into a PLC or into microprocessor functionality included in the controller, as desired) is set to optimize the pumping cycle so that the first stage is filled or nearly filled prior to compressed air being provided to that stage.

Optionally, controller 74 may provide be a dwell time after each pumping cycle, wherein both valves 76 and 78 are turned off, and no compressed gas is being provided to either air line 18 or air line 16, and consequently, to no pumping stage of the system. In the present inventions, further efficiency can be gained by substantially equalizing the pressure in the two air lines, during the period of dwell time. This is accomplished by connecting the exhaust port of valve 76 to the exhaust port of valve 78 during the dwell time. As shown in FIG. 8, a gas save valve 200 is optionally provided as part of the exhaust system of the control unit 70. Gas save valve 200 is additionally controlled by the controller 74. The exhaust ports of valves 76 and 78 are connected in a "T" configuration to the input of the gas save valve 200. The output of the gas save valve 200 is vented to atmosphere.

At appropriate intervals after a pumping cycle, which may additionally be determined from timing signals from the timer 73, the gas save valve 200 is closed. Simultaneously, which ever valve of 76 and 78 that had been turned on, thus providing compressed gas to the pump system, is additionally turned off. This permits the air lines 16 and 18 to be vented to each other, through their exhaust ports, substantially equalizing the pressure in the two air lines. At the completion of the dwell time period, or after it has been detected that the pressure in the two air lines is substantially equalized, the controller 74 again opens the valve 200 to atmosphere, and simultaneously turns on the appropriate valve 76 or 78 for the next pumping cycle.

For example, during a pumping cycle compressed air is provided through valve 78, which is turned on, to air line 16, and thus to a first set of chambers (i.e., chambers 22 and 42 of FIG. 1). Fluid from the chamber(s) is driven into the even stage chambers (i. e., chambers 32 and 52 of FIG. 1) Simultaneously, fluid from the first set of chambers is displacing the air in the second set of chambers which are connected to air line 18 (i.e., chambers 32 and 52 of FIG. 1). Thus, in the above pumping cycle example, valves 200 and 76 (which is turned off) are open to permit the displaced air in the second set of chambers to be vented as exhaust, via exhaust line 210. After the controller 70 determines that the pump cycle is over (by whatever means desired, as described herein) controller turns valve 78 off, and closes the gas save valve 200, thus venting air lines 16 and 18 to each other, through the exhaust ports of valves 76 and 78, via exhaust line 210. After the controller 70 determines that the dwell time period has elapsed, or that the pressure in lines 16 and 18 are substantially equalized, the gas save valve 200 is opened to permit exhaust air from air line 16 (via the exhaust port of valve 78) to vent to atmosphere. Simultaneously, the valve 76 is turned on to permit compressed gas to flow from the compressor 72 to air line 18. This process can then be reversed for the next cycle of pumping reducing compressor run time. The above described cycle of alternate pumping, and equalizing, is repeated after each pumping cycle. Note that the gas save valve 200 of FIGS. 8–11 may be omitted if equalization of the pressure in the gas lines during a dwell time period is not desired.

The filling and emptying of chambers can be further optimized either manually or automatically by monitoring either the input air flow into each of the stages or the exhaust air flow from the chambers. As described above in connection with FIGS. 9 and 10, operation of the above well pump may be modified to exclude reliance on a timer if an appropriate flow rate meter is provided. For example, by measuring airflow into the system or exhaust airflow out of the system, it can be determined when chambers are empty or full, respectively. As such, the timer could be omitted and the air cycled on when the flow meter indicates that a set of chambers is full, or conversely the air cycled off when the flow meter indicates the set of chambers is empty. This method provides for optimized pump cycling without the need for any sensors or wires located down the well. Airflow measurement can also serve as a back-up system if the float system or the sensor system of FIGS. 3 and 10 malfunction.

Figure 9:
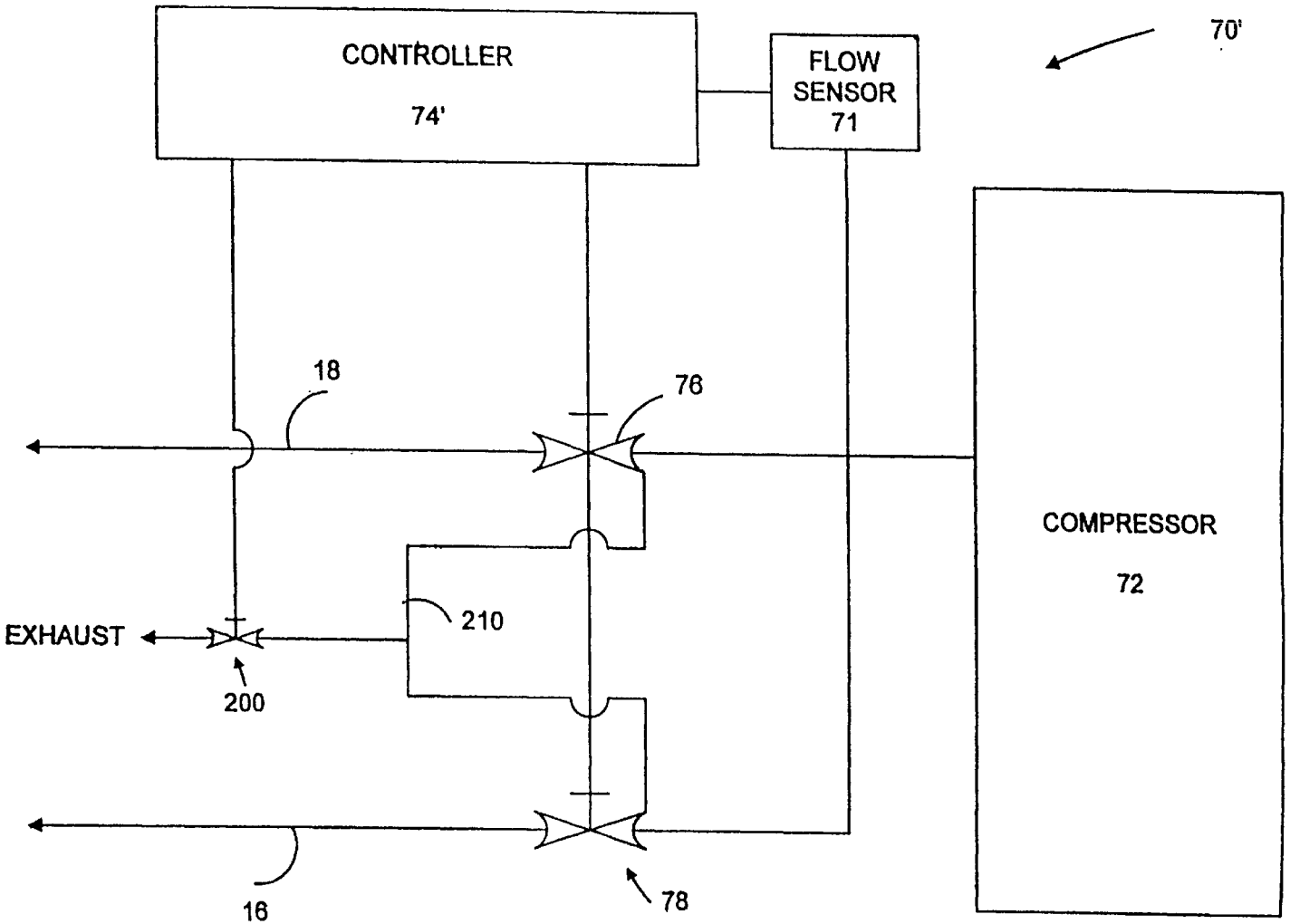
FIG. 9 is a block diagram of a control unit.

FIG. 9 shows a block diagram of a control unit 70' that may be used as the control unit 70 of FIG. 1. As with FIG. 7, a compressor 72 provides compressed air to air line 18 via a valve 76. Similarly, compressor 72 provides compressed air to air line 16 via a valve 78. A controller 74', receives an input from a flow sensor 71, connected to the output of compressor 72, to toggle the valve configuration to alternately cycle valves 76 and 78, open and closed, based on sensed air flow to the chambers via the air lines 16 and 18. Note that the gas save valve 200 of FIGS. 9 and 10 may be omitted if equalization of the gas lines during a dwell time period is not desired.

Figure 10:
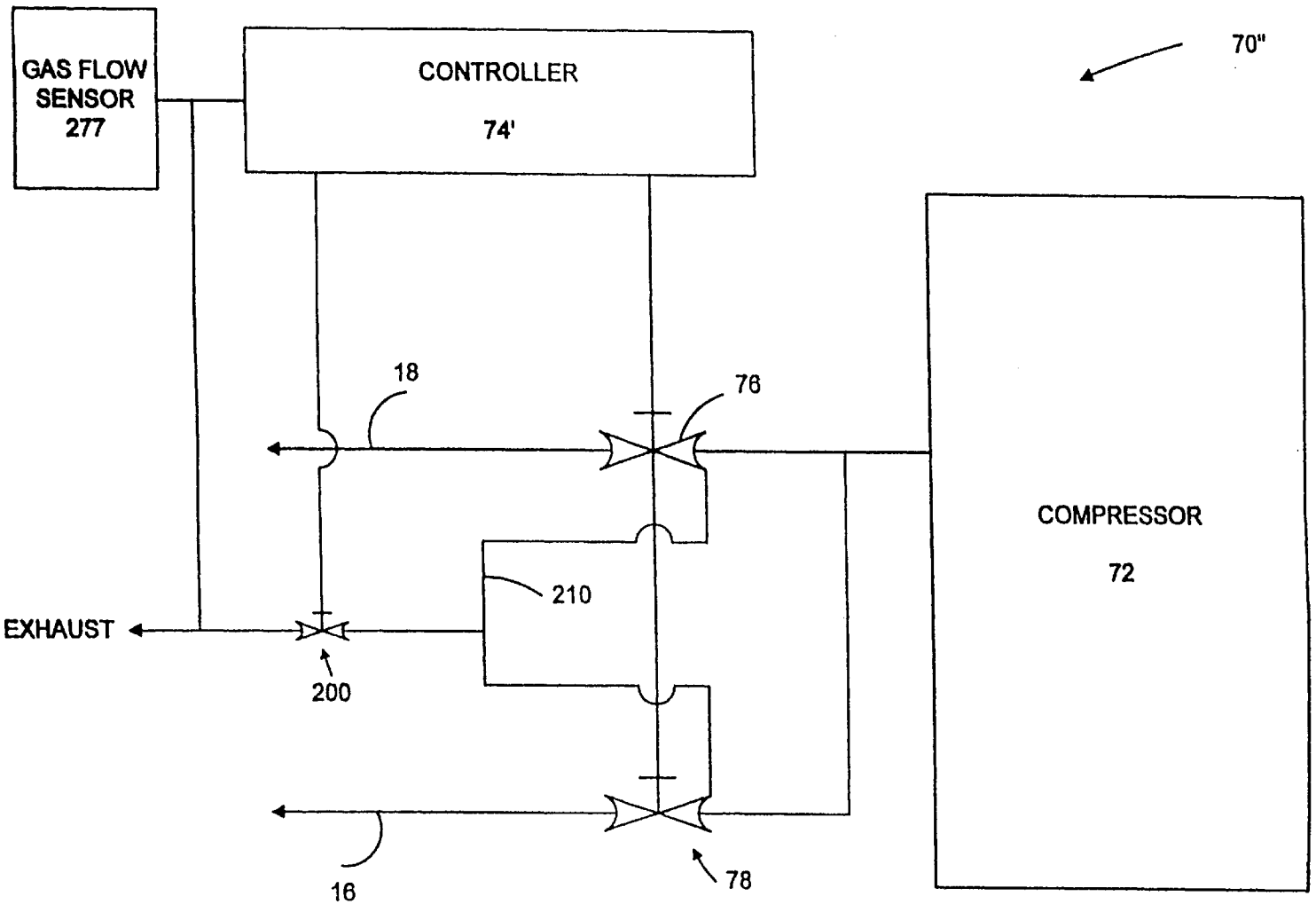
FIG. 10 is a block diagram of a control unit.

The control unit 70" of FIG. 10, is similar in most respects to control unit 70' of FIG. 9. However, in the embodiment of FIG. 10, the output of the exhaust system is connected to air flow sensor 277. Thus when displaced air from filling chambers is vented through gas save valve 200, that air is detected at the air flow sensor 277. It has been determined that noticeable changes in the air flow out of the air lines 16 and 18 occur when the chambers attached thereto are filled with fluid. Thus, when a chamber is filling, the air flow venting from the chamber is noticeably different from the point in time when the chamber is, in fact, full or when the chamber feeding that chamber is empty and sealed by the float valve. The air flow sensor 277 provides information to the controller 74'. Based upon the above flow rate information, the controller can thus optimize the pumping cycle by turning off the compressed air to the now empty chambers. Thus, measured air flow can used to cycle valves 76 and 78 to provide compressed air alternately to air lines 16 and 18 without operating purely on the basis of time. Additionally, pressure can be substantially equalized in the down hole portion of air lines 16 and 18 by venting those lines to each other, as additionally described in connection with FIG. 8.

Further, in the embodiments described above including an air flow sensor, instead of providing information directly to the controller, the air flow sensor may be monitored by an operator during hardware setup to manually adjust the controller. The above described control units 70,, 70' and 70" of FIGS. 8–10 may all be used as the control unit 70 of FIG. 1. Additionally, the exhaust venting and equalizing systems described in connection with FIGS. 8 and 10, may be used (with or without the air flow sensor 277), with any of the well pump systems described herein. Additionally, the gas flow may be monitored using the gas flow sensor 71 of FIG. 9 or 277 of FIG. 10, to optimize the timing in a system such as shown in connection with FIGS. 1, 7, and 8.

Figure 7:
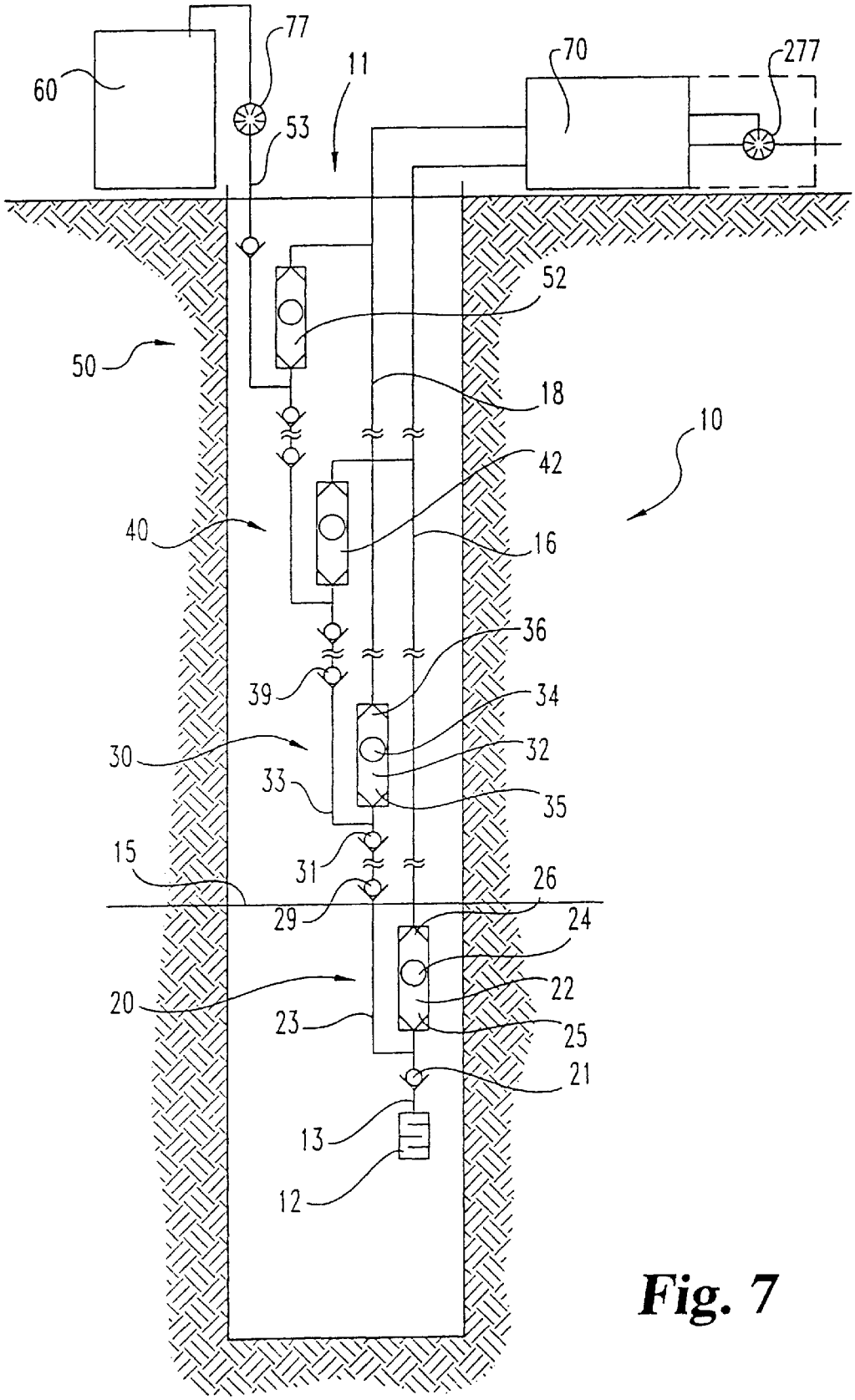
FIG. 7 is a schematic view of one embodiment of the present invention.

In low production wells, extended cycles may be necessary to allow the bottom chamber 22 to fill with fluid. A fluid sensor 77 may be connected to the output of the fluid line 53, as shown in FIG. 7, to determine how much fluid has been pumped during that cycle. Alternatively, a fluid flow sensor could be used with the time of flow, indirectly measuring how much fluid is pumped. The direct or indirect fluid measurement can be used to optimize the overall cycle time allowing chamber 22 to just fill with fluid between cycles. The sensor 77, as described herein, may be used in connection with any embodiment of the inventions described herein, if desired. FIG. 7 particularly depicts the use of a fluid flow meter 77 in connection with a system that cycles the valves 76 and 78 in connection with detected air pressure at the exhaust ports of those valves, such as was described in connection with FIG. 10. FIG. 7 is substantially similar to FIG. 1, in all other respects.

Alternatively, in one embodiment to be described more fully in conjunction with FIG. 3 below, a simple magnetic sensor, located on the first stage, detects when the bottom reservoir 20 is filled with fluid. This input signal to unit 70'" of FIG. 11 causes the controller 74'" to begin a new cycle by energizing valve 78.

Figure 4:
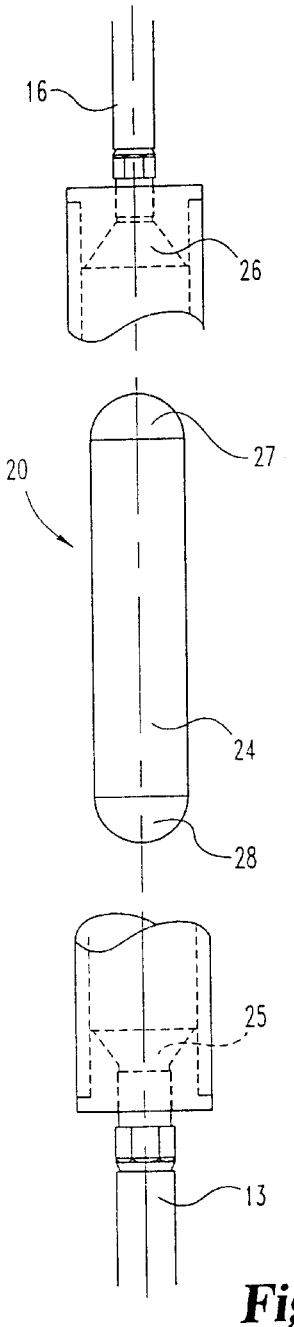
FIG. 4 is a partial enlarged view of a fluid chamber and float according to one embodiment of the invention.
Figure 4A:
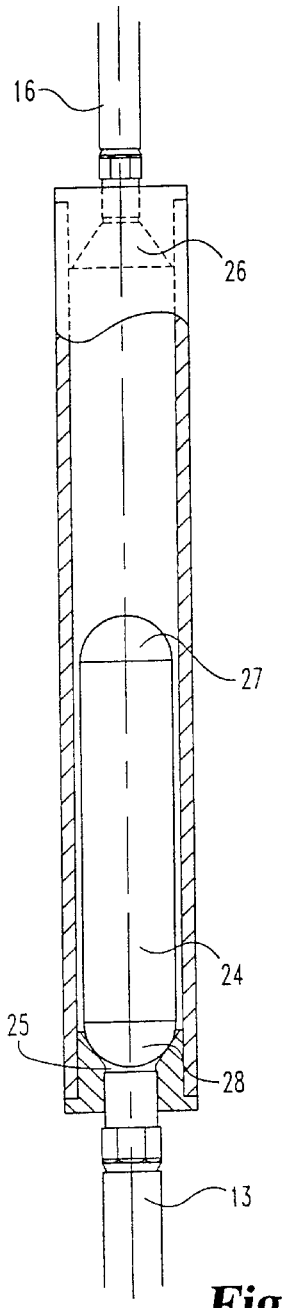
FIG. 4A is a cut-away view of a fluid chamber with a float when the chamber is empty according to a embodiment of the invention.
Figure 4B:
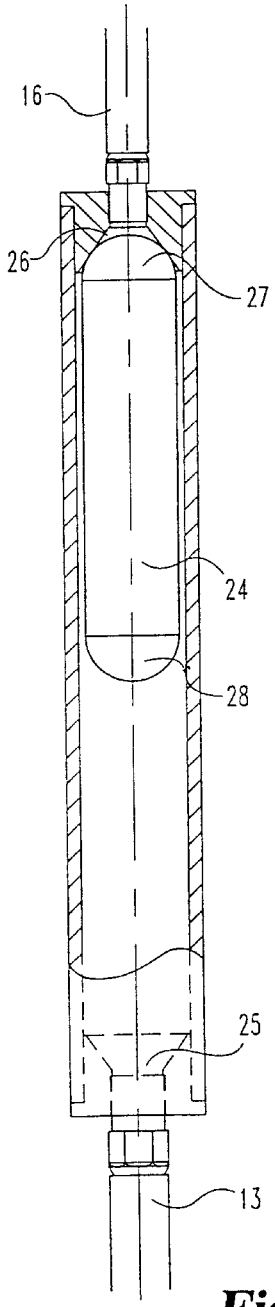
FIG. 4B is a cut-away view of a fluid chamber with a float when the chamber is full according to a embodiment of the invention.

FIGS. 4, 4A and 4B show a cut-away view of the pumping chamber 20 of FIG. 1. The pumping chamber 22 of FIG. 4 is additionally exemplary of all pumping chambers described in connection with the embodiment of FIG. 1 of the invention. The pumping chamber 22 of FIG. 4 is generally cylindrical in cross section in its main body portion and includes a float or float valve 24 which is chosen to be buoyant in the desired fluid. Each fluid storage chamber has base end 25 and top end 26. Float valve 24 includes top end 27 and base end 28. In at least one embodiment of the present inventions, the top end and base end portions of generally cylindrical chamber 22, are tapered to form valve seats at each end of the chamber. Base end 28 of float valve 24 is adapted to seat in and engage base end 25 of the chamber to serve as a float valve, sealing the chamber and preventing air from entering fluid conduit 13 when the chamber is empty, as shown in FIG. 4A. Optionally, top end 27 of float valve 24 is adapted to engage top end 26 of the chamber when the chamber is full, thus preventing fluid from entering air conduit 16, as shown in FIG. 4B. However, as described below in connection with additional embodiments of the present inventions, the top end 26 of the chamber need not be adapted to engage the top end of the float 24, if the compressor is switched off based on some factor other than purely a time based system. The float valve is disposed in the chamber directly between the fluid aperture from which fluid enters and leaves the chamber and the air aperture, from which compressed air enters the chamber, and from which the exhaust air vents when the chamber is filled.

The operation of the well pump of FIG. 1 will now be described in connection with one embodiment of the present inventions. Referring now to FIGS. 1, 8, 4, 4A and 4B, first stage 20 is placed below fluid level 15 of well 11. Since first stage 20 is the lowest pumping stage below the fluid level, fluid will enter strainer 12, pass check valve 21, travel through input conduit 13 and enter chamber 22, causing the float 24 to rise. Fluid will continue to enter chamber 22 until that chamber is full, or until compressed air is provided to drive the fluid from that chamber. As the chamber fills, the float 24 rises, until the top of the float sealingly engages the top end 26, of the chamber, thus preventing fluid from entering the air line 16.

After a period of time determined by the timer 73, the controller 74 will open valve 78, and close valve 76, which provides the compressed air from compressor 72 to the first chamber (and to the odd numbered stages, i.e. 3, 5, etc., if present), via air line 16. While compressed air is provided to chamber 22, no compressed air is being provided to the second pumping stage. The compressed air forces the fluid through fluid output conduit 23 and into fluid chamber 32 of second pumping stage 30. As the chamber empties, the float 24 is lowered, until the bottom surface of the float sealingly engages with the bottom portion 25 of chamber 22. At this point, the majority of the fluid has passed through check valve 29 and check valve 31 and has entered fluid chamber 32. Float 34 rises with the rising fluid level, and engages the top portion of the chamber to prevent fluid from entering the air line, if the chamber 32 is sufficiently filled. Check valves 29 and 31 prevent the fluid in fluid line 23 from returning to first pumping stage 20.

One of check valves 29 and 31 (and a corresponding valve in each stage) could be eliminated if the tubing is rated at least twice that of the supplied air pressure. If check valve 31 were eliminated, check valve 29 would be required to carry the combined pressure of the supplied air and the weight of the fluid column, i.e., about twice the supplied air pressure. By including check valve 31, and similar valves at each pumping stage, the tubing can be rated at only the supplied air pressure. By way of illustration, the fluid chambers may be 20 feet in height and the pumping stages may be vertically displaced by 250–300 feet. Compressed air at 150 psi may be supplied independently to first air line 16 and second air line 18.

At a second predetermined time based on signals received from the timer 73, the controller will cause the valve 78 to close and the valve 76 to open, thus providing the compressed air to the second stage 30 (and to the even numbered stages, i.e. 2, 4, etc., if present). While compressed air is being provided to the chamber 32, chamber 22 of the first stage 20 is permitted to fill again with fluid. Additionally, the compressed air on air line 18 forces the fluid in the second pumping chamber 32, either to a tank at the surface, or alternatively, if present, into a third pumping stage, such as pumping stage 40 of FIG. 1. As the chamber 32 empties, float 34 sealingly engages the bottom portion 35 of chamber 32. Check valve 31 prevents the fluid from returning to first pumping stage 20.

The cycle is then repeated, wherein a compressed gas is supplied to the even numbered stages to drive the fluid in those stages into higher level stages, or to a holding tank above ground. During this cycle, the lowest stage of the pumping system is permitted to refill with fluid naturally. As described herein, pumping is cyclically repeated between the odd numbered stages (connected to air line 16) and the even numbered stages (connected to air line 18), thus alternately pumping fluid from the odd numbered stages to the even numbered stages located above them (the lowest odd numbered stage being allowed to fill), and from the even number stages to the odd numbered stages above them.

Additionally, the air lines may, optionally, be substantially equalized at the end of each pump cycle, as described more fully in connection with FIG. 8. Additionally, during each pumping cycle, the air line not currently pressurized is vented to atmosphere through the valve exhaust port, as chambers attached thereto are filled, as described in connection with FIGS. 8–11.

As detailed herein, the present inventions will function with as few as a single pumping stage. However, depending on the depth of the well, more pumping stages may be desired. In the embodiment shown in FIG. 1, four such pumping stages are used. In that embodiment, when compressed air is provided to the first and third stages, via air line 16, any fluid in the second third stage is additionally driven to the fourth stage, in the same way as described above in connection with the first stage. Likewise, when compressed air is provided to the second and fourth stages via air line 18, any fluid in the fourth stage is driven to storage tank 60 at the surface in similar fashion to that described above in connection with operation of the second stage. Additionally, it is expected that in some situations more than four stages may be used.

Operation of the well pump of FIG. 1 in connection with the control units of FIGS. 9 and 10 would be substantially similar to that described above in connection with FIG. 8, with the following exceptions. If the control unit 70' of FIG. 9 or the control unit 70" of FIG. 10 were used instead of the control unit 70 of FIG. 8, the controller would cycle the valves based on sensed gas flow. For example, in a system including the control unit 70", the operation of the well pump of FIG. 1 would operate substantially as described above in connection with FIGS. 1 and 8, with the exception that the valves would not be cycled based on the basis of a timer input, but rather would be cycled based upon a substantially diminished air flow from the output of the exhaust line 210, indicated by the flow sensor 277.

Figure 3:
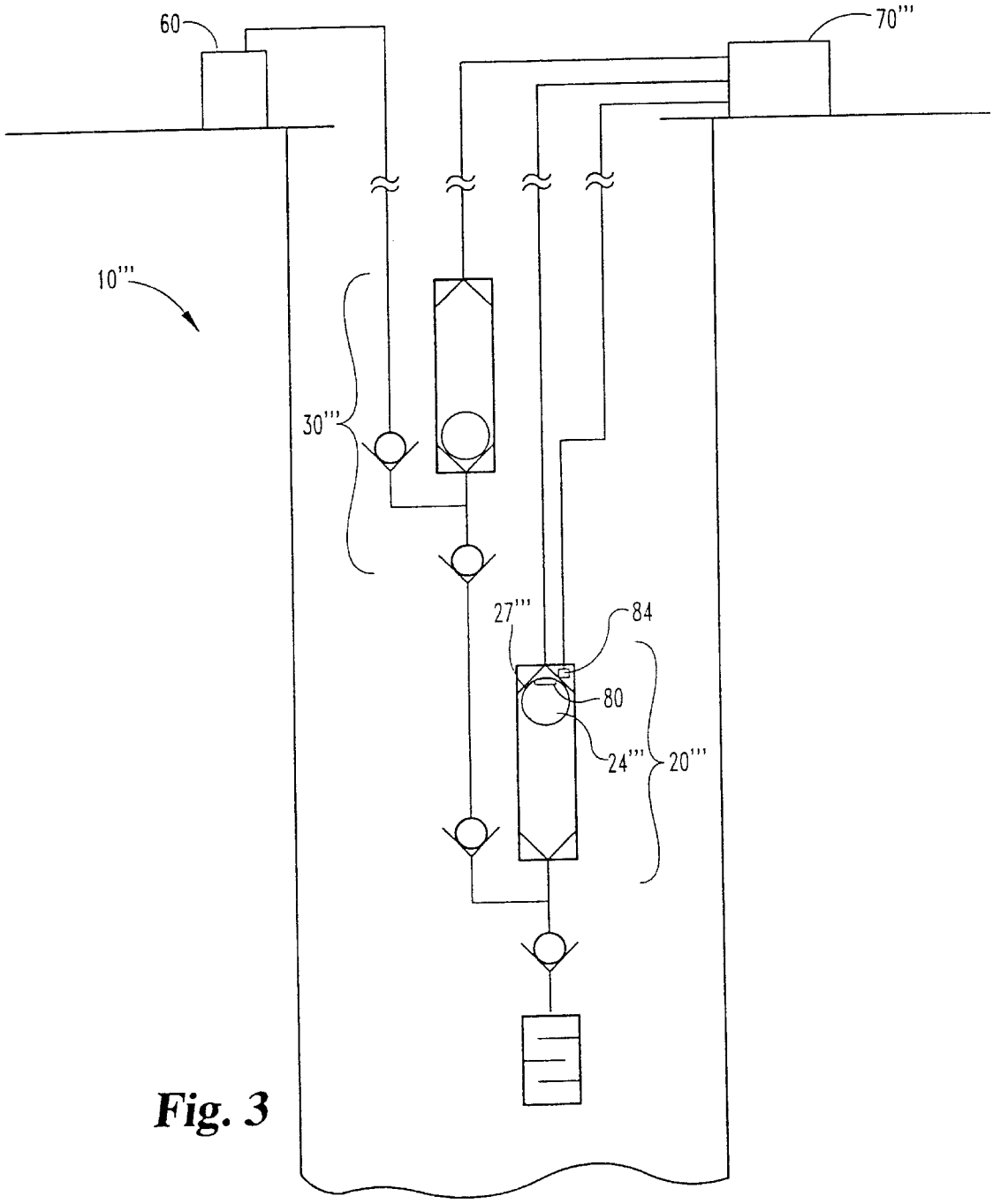
FIG. 3 is a partial schematic view of one embodiment of the invention.
Figure 11:
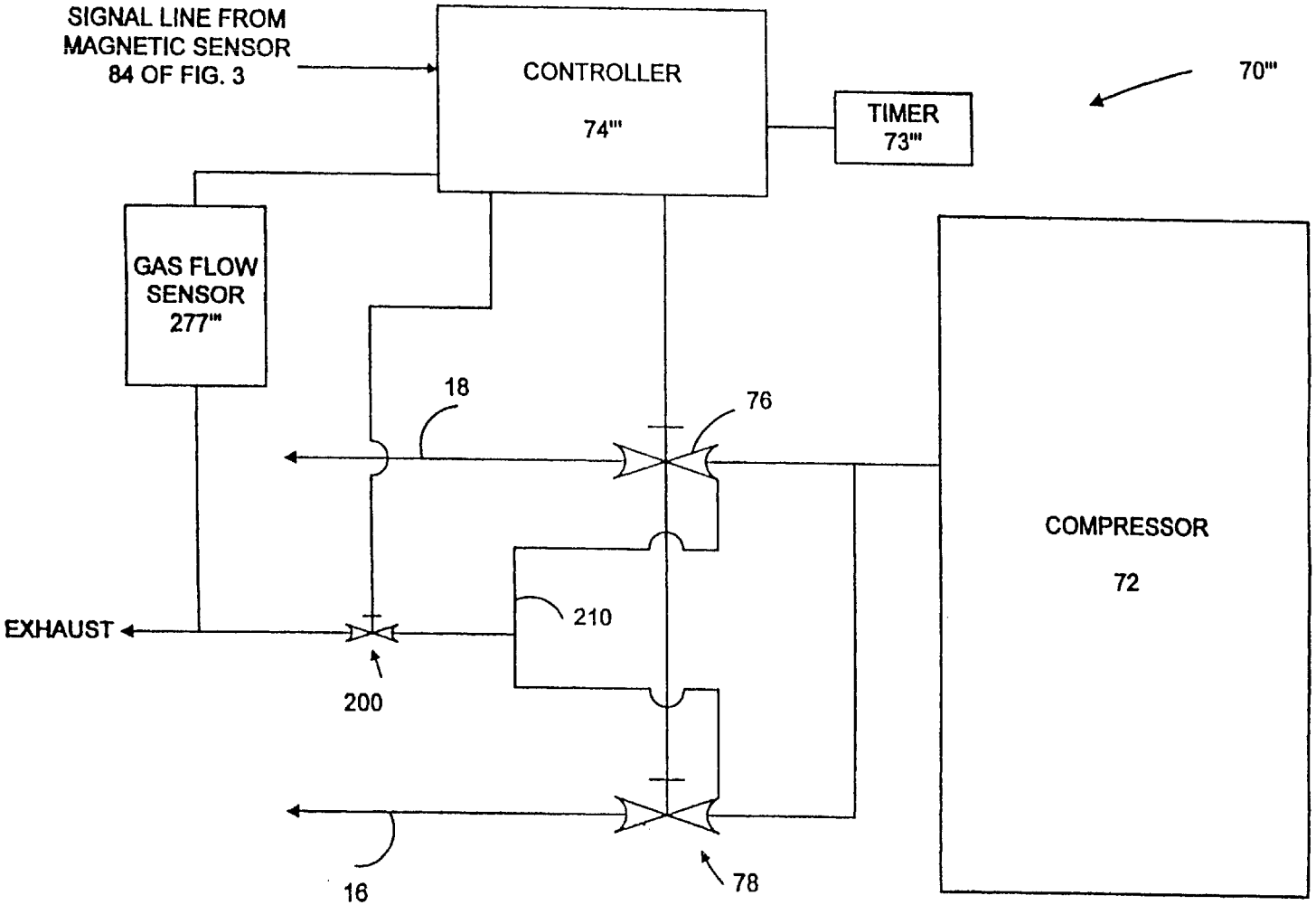
FIG. 11 is a block diagram of a control unit.

Referring more specifically to FIGS. 3 and 11, there is shown another embodiment of the present inventions. As described in connection with FIG. 1, above, the invention of FIG. 3 can include at least a single stage, or more if desired (as shown in FIG. 3). The operation of the pump 10'" of FIG. 3 is similar to that of FIG. 1. Fluid enters the stage 20'", causing the float 24'" to rise with the fluid level. However, rather than operating based solely on time or airflow, as described above in connections with FIGS. 1 and 8–10, the present embodiment includes a magnetic disk located in the top portion of the float 24'". Additionally, a single magnetic sensing device 84, is located at the top portion 27'" of the first stage 20'", external to the chamber. When the float 24'" rises, and the magnet 80 is brought into close proximity to the magnetic sensing device 84, the controller 70'" causes the air provided to the first (and any additional odd numbered stages present) to be turned on. Optionally, a timer 73'" may provide a timing signal to the controller 74'" which is used to turn off the air to the first stage after a predetermined time. Alternatively, a flow rate sensor system 277'", such as described in connection with FIG. 10 may be provided instead of or in addition to the timer to cause the controller to cycle the air between the sets of pumping stages at a desired time when the magnet 80 is not in close proximity to the magnetic sensing device 84. The use of the magnetic sensor and the air flow sensor further optimizes the filling and emptying of the chambers, while adding only one sensor to the pump located in the well.

In deeper wells it may be desirable to avoid the accumulation of pressure by not permitting the float 24 to seal against top end 26 of chamber 22 in lowest pumping stage 20. In the system of FIG. 3, it is unnecessary to have the float sealingly engage with the top portion of the chamber, because the compressed air is turned on as soon as the magnet is sensed. In fact, as all chambers are of relatively equal volume, no stage, except possibly the topmost stage, requires that the float sealingly engage the top portion of the chamber. Similarly, if the flow rate meter control system were to be used as described in connection with FIGS. 9 and 10, with or without the magnetic sensor, the float would, likewise, not need to be sealingly engaged with the top of the chamber.

Note also that stage 30''' of FIG. 3 does not include a magnet/magnetic sensor pair. Rather, again because all chambers are of relatively equal volume, it is only necessary to provide a magnetic sensor on the first stage 20'''. By providing only the first stage with a magnetic sensor read at the surface, this provides the advantage of reducing the cost and maintenance of sensors and wire located down the well.

Figure 5:
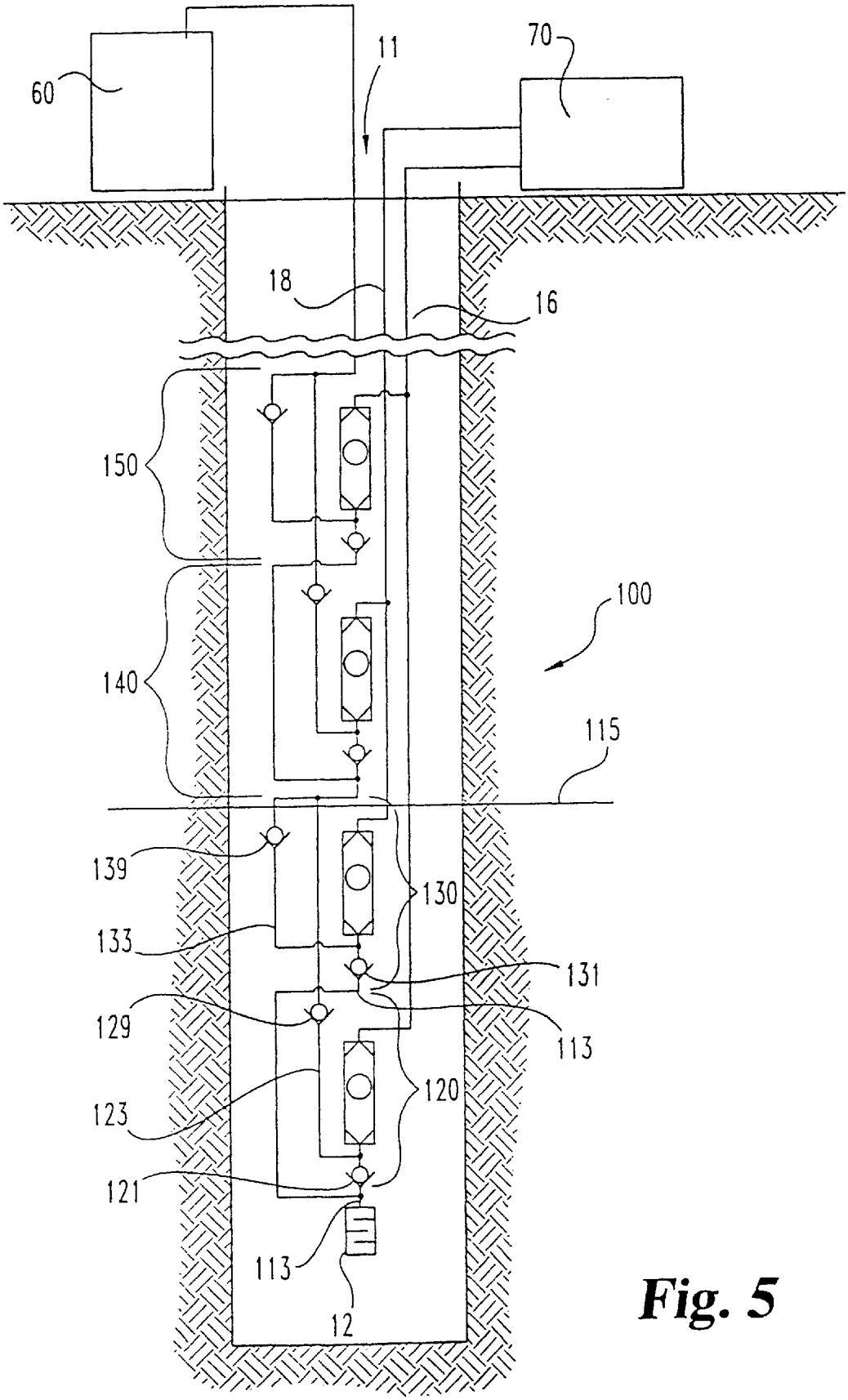
FIG. 5 shows an alternate embodiment of the present inventions.

For higher flow-capacity wells, an alternate duplex pumping system 100 is illustrated in FIG. 5. As shown, duplex-pumping system 100 includes first and second stages 120 and 130 and additional pumping stages 140 and 150 as needed. As with the embodiment of FIG. 1, additional pumping stages may be added as desired. In duplex pumping system 100, first stage 120 and second stage 130 are below fluid level 115. Fluid enters strainer or other filter 12 into fluid input conduit 113, passes check valve 121 and enters first pumping stage 120. At some time after the first pumping stage 120 is full, first compressed air line 16 is pressurized and forces fluid from first pumping stage 120 through fluid output conduit 123, and output check valve 129 into third pumping stage 140. Note that control unit 170 of FIG. 5, can be any of those control units described herein in connection with FIGS. 1, 3, and 7–11, above. The fluid is emptied from the pumping stage 120, as described above in connection with FIGS. 1, 3 and 7–11, into the chamber of pumping stage 140, until the fluid is removed from first pumping stage 120 and the float sealingly engages with the bottom of the chamber. After which, the air line 16 is turned off by the control unit 70 using one of the means (i.e., timer and/or magnetic sensor and/or air flow sensor) described herein.

While first pumping stage 120 is being emptied, fluid will continue through fluid input conduit 113 past check valve 131 and into second pumping stage 130. Once air line 16 is turned off and air line 18 is turned on, the compressed air supplied to pumping stage 130 forces the fluid in pumping stage 130 through fluid output conduit 133 and check valve 139 into fourth pumping stage 150. From stages 140 and 150, the fluid is driven either to additional stages not shown in FIG. 5, or to the above ground storage tank 60.

First and second pumping stages 120 and 130 are alternately filled and emptied to allow almost continuous filling and fluid movement, thus permitting essentially a 100% duty cycle. Once a pumping stage has completed its cycle and been emptied, the air supply conduit to that pumping stage is vented allowing additional fluids to enter the pumping stage. First compressed air line 16 is attached to a first set of pumping stages including first and fourth pumping stages 120 and 150 and second compressed air line 18 is attached to a second set of pumping stages including second and third pumping stages 130 and 140.

Although fluid removed from second pumping stage 130 could enter third pumping stage 140 if there were no pressure, the common pressure supply line 18 to second pumping stage 130 and third pumping stage 140 prevents fluid from entering third stage 140 while second stage 130 is being emptied, thus making the fluid divert to fourth pumping stage 150. Additional pumping stages can be added and supplied by the appropriate compressed air conduit so that the fluid alternates between a pumping stage in the first set and a pumping stage in the second set. The stages may be vented and/or substantially equalized, as described in connection with FIGS. 8 and 10, above.

Figure 6A:
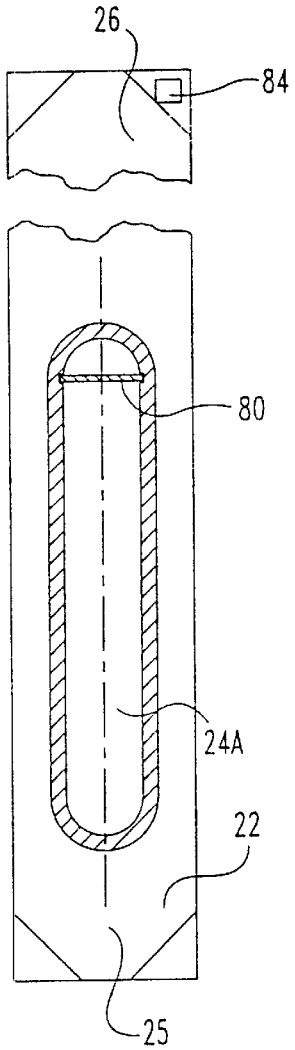
FIGS. 6A, 6B and 6C show alternate embodiments of floats in a fluid chamber according to preferred embodiments of the invention.
Figure 6B:
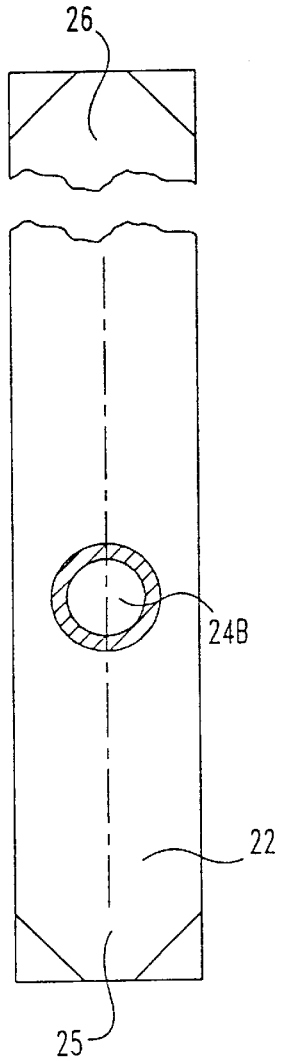
Figure 6C:
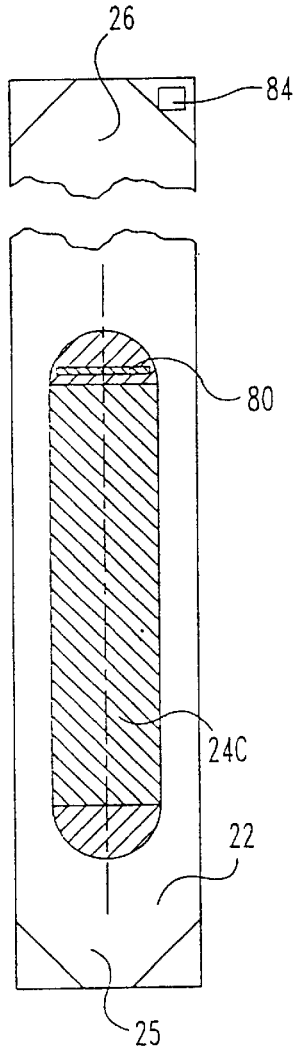

Illustrated in FIGS. 6A, 6B and 6C are some possible float valves for use with the present inventions. FIG. 6A shows a float 24A which may consist of an air filled tube with "rubber" semi spheres sealed at both ends. These semi spheres are constructed to engage top end 26 or bottom end 25 of chamber 22 and prevent the entrance of excess air or excess fluid, if desired. In a second embodiment, float 24B may be a ball which is either hollow or solid with a low specific gravity which floats in the fluid. A third float embodiment 24C is illustrated where the float is a solid tube made from a material with a low specific gravity. Optionally, any of these floats may be adapted to include a magnet 80, as shown in FIGS. 6A and 6C, so as to be useful in the embodiment described in connection with FIGS. 3 and 10. However, if not used with a magnetic sensor, as described herein, the magnets 80 are omitted.

First embodiment float 24A must be a material with an internal air pressure or mechanical mechanism to prevent implosion due to air line pressures or formation pressures in the well. Second embodiment float 24B could also be hollow with the required internal air pressure and does not require that a floating tube remain upright. Use of a solid material, such as in third embodiment 24C further reduces the risk of implosion of the float. If a solid type of float is used, the material must have a sufficiently low specific gravity to float in the pumped fluid.

The well pump as described herein is designed to reduce cost and maintenance. Additionally, as down well sensors are either eliminated completely, or minimized, only a minimum of electronics is required. To further reduce cost and complexity, it is preferred that the pipes, check valves and other equipment be made from readily available parts such as polyethylene tubing, brass, stainless steel, heavy grade PVC tubing or other plastic components. These parts can be moved to the well site without the use of heavy trucks, etc. and assembled without specialized well field equipment. Alternatively, for increased strength or other reasons, the components could be made of metals or other materials as commonly understood by those of skill in the art. Similarly, the floats are preferably made of chemically resistant rubber, but alternate materials could be used.

The above inventions are described in connection with the pumping of oil, but it is understood that the above system could be used to pump water or other fluids. Additionally, as described herein, any number of stages greater than two can be used. Further, the above inventions can be adapted for use as a single stage pump, by providing a single air line to the chamber of the single stage, and by having the controller cycle the compressor on and off (or alternatively, by opening and closing the valve to the single air line) and by cycling the compressor using any of the above described controller units.

Since it is most readily available, ambient air is preferred for compression and supply through the air lines; however, natural gas, carbon dioxide, or other gases may also be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid pumping system for pumping a fluid source from a well, comprising:

a pressurized gas source;

at least a first pumping stage located in the fluid source down the well, said at least a first pumping stage comprising:

at least a first fluid chamber, said first fluid chamber having a top and a bottom, said top including a first gas aperture in communication with said pressurized gas source, said bottom including a first fluid intake aperture in communication with the fluid source, and a first fluid outlet in communication with said first fluid chamber and a storage chamber above said first pumping stage; and a first float disposed in said first fluid chamber, said first float including a top portion and a bottom portion, wherein in operation said top portion of said first float seals said first gas aperture of said first fluid chamber when said first fluid chamber is substantially full of fluid from the fluid source whereupon pressurized gas is provided to said first gas aperture to move said float toward said bottom of said first fluid chamber to direct fluid through said first fluid outlet, whereupon when said first fluid chamber is substantially empty said bottom of said first float seals said first fluid outlet preventing pressurized gas from being delivered therethrough.

2. The fluid pumping system of claim 1, wherein said first fluid aperture includes a tapered portion and said first gas aperture includes a tapered portion.

3. The fluid pumping system of claim 2, wherein said top portion and said bottom portion of said first float are rounded to seat in respective ones of said tapered portions of said first gas aperture and said first fluid aperture.

4. The fluid pumping system of claim 3, wherein said first float includes a hollow cylinder between said top portion and said bottom portion.

5. The fluid pumping system of claim 1, wherein upon sealing of said first gas aperture with said first float a signal is provided to supply pressurized gas to said first fluid chamber through said first gas aperture.

6. The fluid pumping system of claim 1, wherein upon sealing of said first fluid outlet with said first float a signal is provided to stop supplying pressurized gas to said first fluid chamber.

7. The system of claim 1, wherein said first fluid outlet is in communication with said first fluid intake and said bottom of said first float simultaneously seals said first fluid outlet and said first fluid intake aperture when said first fluid chamber is substantially empty.

8. The system of claim 1, further comprising:

a second pumping stage located above said first pumping stage, said second pumping stage comprising:

a second fluid chamber including a top and a bottom, said top including a second gas aperture in communication with said pressurized gas source, said bottom including a second fluid intake aperture in communication with said first fluid outlet, and a second fluid outlet in communication with said second fluid chamber and said storage chamber;

a second float disposed in said second fluid chamber between said second gas aperture and said second fluid outlet, said second float including a top portion and a bottom portion, wherein in operation said top portion of said second float seals said second gas aperture of said second fluid chamber when said second fluid chamber is substantially full with fluid received from said first fluid outlet of said first fluid chamber whereupon pressurized gas is provided to said second gas aperture to move said second float toward said bottom of said second fluid chamber to direct fluid through said second fluid outlet, whereupon when said second fluid chamber is substantially empty said bottom of said second float seals said second fluid outlet preventing pressurized gas from being delivered therethrough.

9. The fluid pumping system of claim 8, wherein upon sealing of said second gas aperture with said second float a signal is provided to stop supplying pressurized gas to said first fluid chamber through said first gas aperture.

10. The fluid pumping system of claim 8, wherein upon sealing of said second fluid outlet with said second float a signal is provided to supply pressurized gas to said first fluid chamber through said first gas aperture.

11. The system of claim 8, wherein said second fluid outlet is in communication with said second fluid intake and said bottom of said second float simultaneously sealings said second fluid outlet and said second fluid intake aperture when said second fluid chamber is substantially empty.

12. A fluid pumping system for pumping a fluid source from a well, comprising:

a pressurized gas source;

a first fluid chamber located in the fluid source down the well, said first fluid chamber including:

a top and a bottom, said top including a first gas aperture in communication with said pressurized gas source, said bottom including a first fluid intake aperture in communication with the fluid source, and a first fluid outlet in communication with said first fluid chamber and a storage chamber above said first pumping stage;

a first float disposed in said first fluid chamber between said first gas aperture and said first fluid intake aperture, said first float including a top portion and a bottom portion, wherein in operation said top portion of said first float seals said first gas aperture of said first fluid chamber when said first chamber is substantially full of fluid from the fluid source and said bottom of said first float seals said first fluid outlet preventing pressurized gas from being delivered therethrough;

a second fluid chamber above said first fluid chamber, said second fluid chamber including:

a top and a bottom, said top including a second gas aperture in communication with said pressurized gas source, said bottom including a second fluid intake aperture in communication with said first fluid outlet, and a second fluid outlet in communication with said second fluid chamber and said storage chamber; and a second float disposed in said second fluid chamber between said second gas aperture and said second fluid outlet, said second float including a top portion and a bottom portion, wherein in operation said top portion of said second float seals said second gas aperture of said second fluid chamber when said second fluid chamber is substantially full from fluid received from said first fluid outlet of said first fluid chamber and when said second fluid chamber is substantially empty said bottom of said second float seals said second fluid outlet preventing pressurized gas from being delivered therethrough, wherein in operation pressurized gas is delivered to said first fluid chamber through said first gas apertures until the occurrence of at least one of said first float sealing said first fluid outlet and said second float sealing said second gas aperture.

13. The system of claim 12, wherein delivery of pressurized gas is initiated upon the occurrence of at least one of said first float sealing said first gas aperture of said first fluid chamber and said second float sealing said second fluid outlet of said second fluid chamber.

14. The system of claim 12, wherein:

said first fluid outlet is in communication with said first fluid intake and said bottom of said first float simultaneously seals said first fluid outlet and said first fluid intake aperture when said first fluid chamber is substantially empty; and said second fluid outlet is in communication with said second fluid intake and said bottom of said second float simultaneously seals said second fluid outlet and said second fluid intake aperture when said second fluid chamber is substantially empty.

15. The system of claim 12, wherein said pressurized gas source is compressed air.

* * * * *